US006435063B1

(12) United States Patent
Chen

(10) Patent No.: US 6,435,063 B1
(45) Date of Patent: Aug. 20, 2002

(54) BOX END WRENCH

(76) Inventor: Ching Chen, 1 Alley 2 Lane 741 Tung-Ping Rd., Taiping City, Taichung Hsien (TW)

( * ) Notice: Subject to any disclaimer, the term of this patent is extended or adjusted under 35 U.S.C. 154(b) by 0 days.

(21) Appl. No.: 09/846,533

(22) Filed: Apr. 30, 2001

(51) Int. Cl.[7] ..... B25B 13/46
(52) U.S. Cl. ..... 81/63.2
(58) Field of Search ..... 81/61–63.2

(56) References Cited

U.S. PATENT DOCUMENTS 5,913,954 A * 6/1999 Arnold et al. ..... 81/63.2
5,957,009 A * 9/1999 McCann ..... 81/63.2
6,260,449 B1 * 7/2001 I-He ..... 81/63.2

* cited by examiner

*Primary Examiner*—D. S. Meislin
(74) *Attorney, Agent, or Firm*—Pro-Techtor International Services

(57) ABSTRACT

An improved box end has substantially no projected manipulation element in a trigger member. A channel in the head is in communication with a central opening with a notched member disposed therein and a slope between the head and the handle. The manipulation element is clockwise or counterclockwise rotatable in a distance defined by the width of channel for moving a spring-loaded steel ball from one slot to the other slot of a follower coupled between trigger member and notched member, thereby adjusting the position of notched member for aligning with an object to be held. Further, this wrench is sightly.

3 Claims, 7 Drawing Sheets

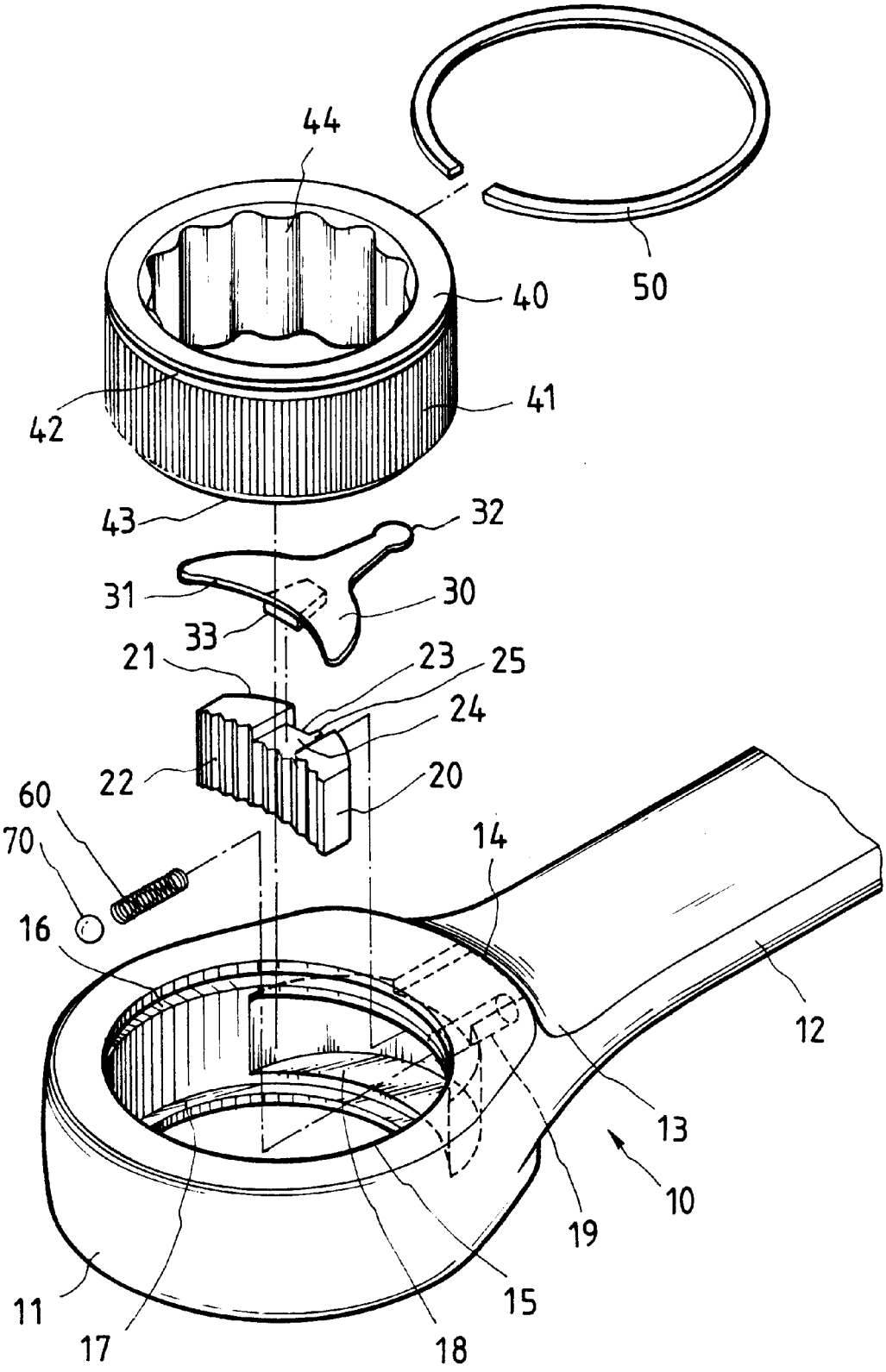
FIG, 2

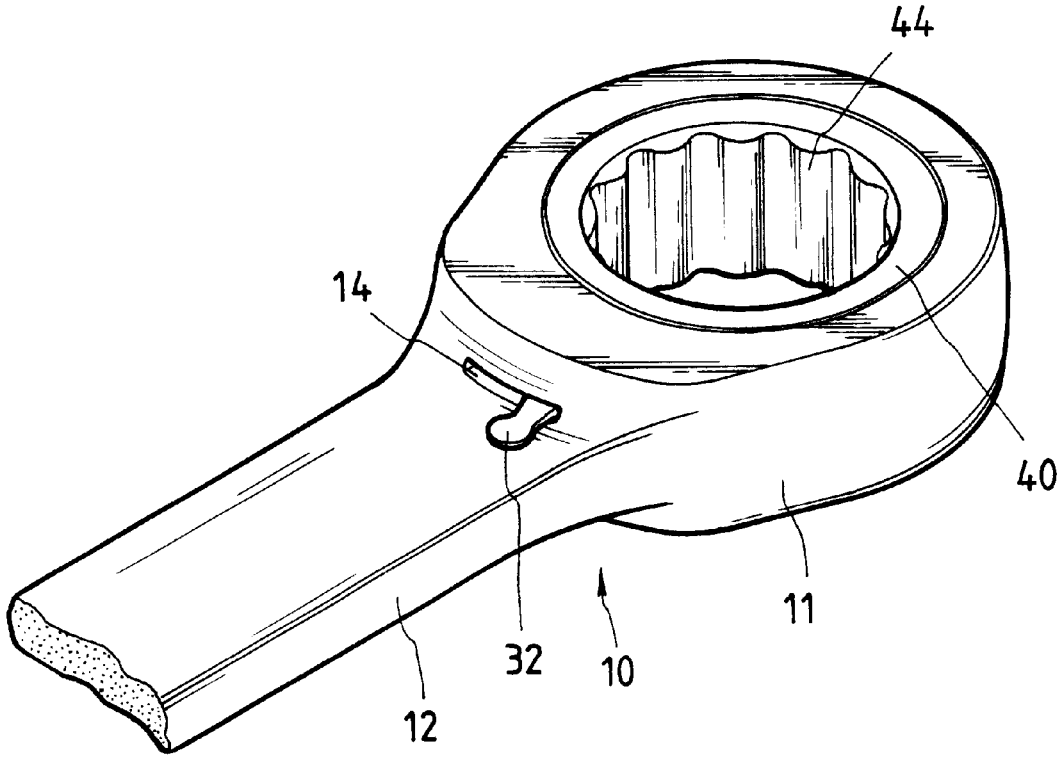
FIG, 3

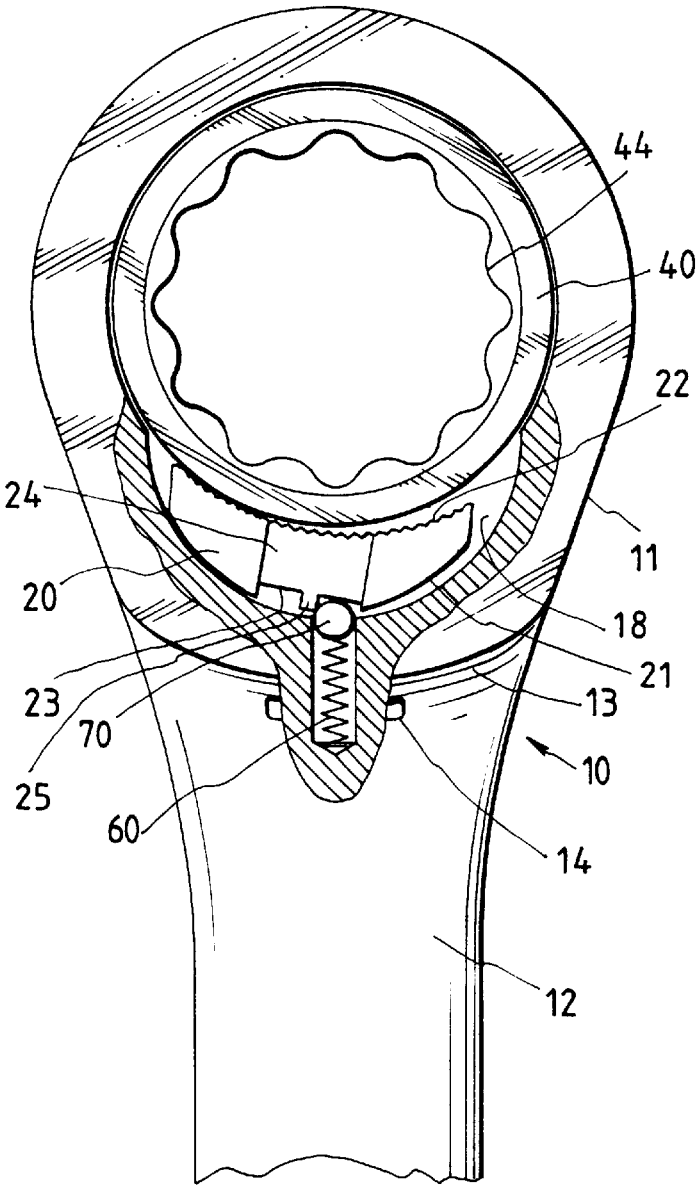
FIG, 4
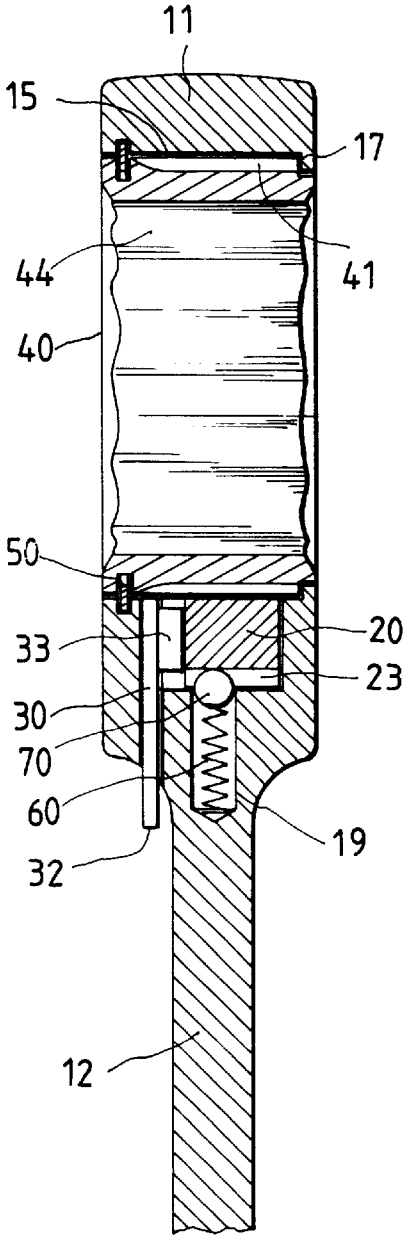
FIG, 5

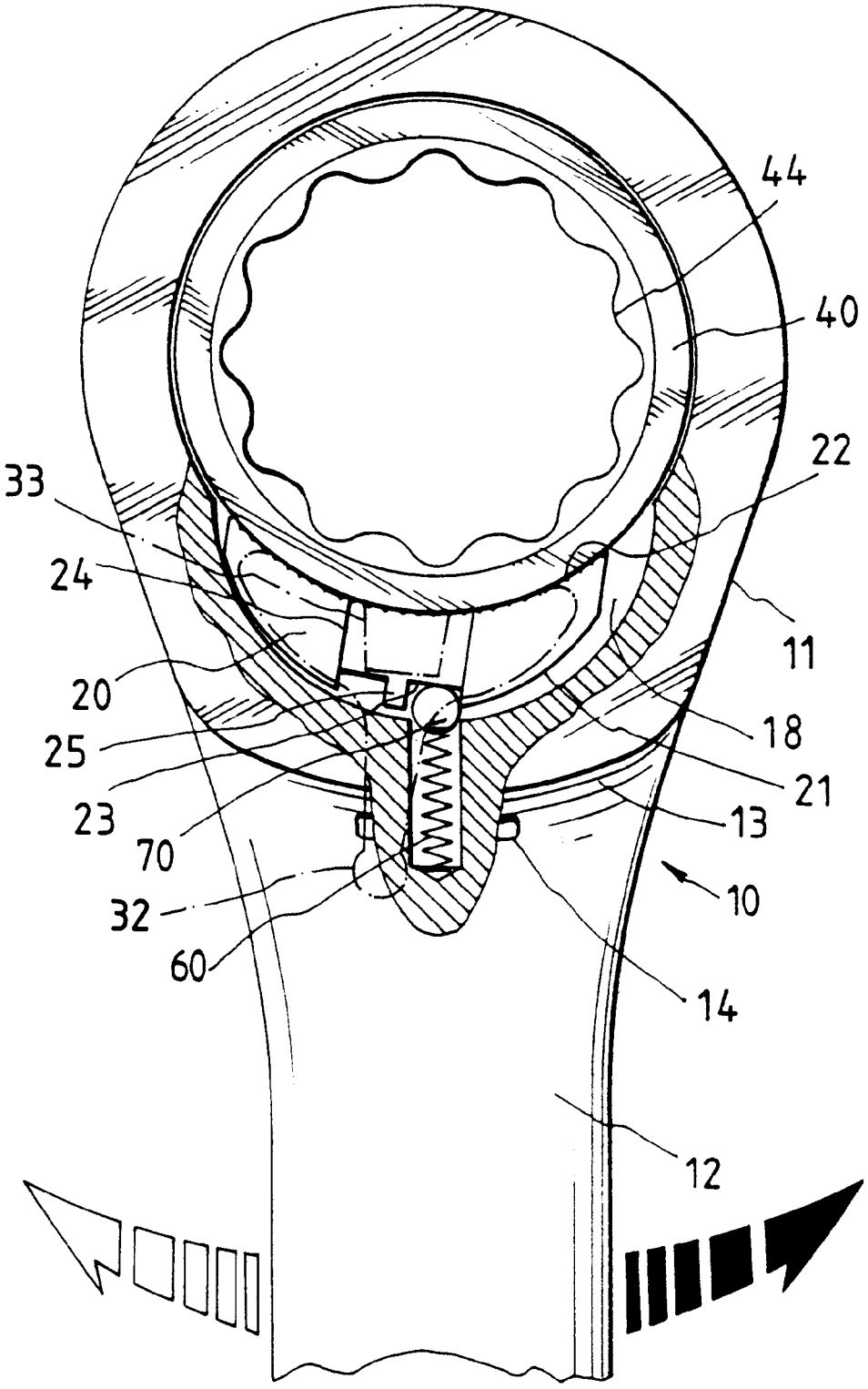
FIG, 6

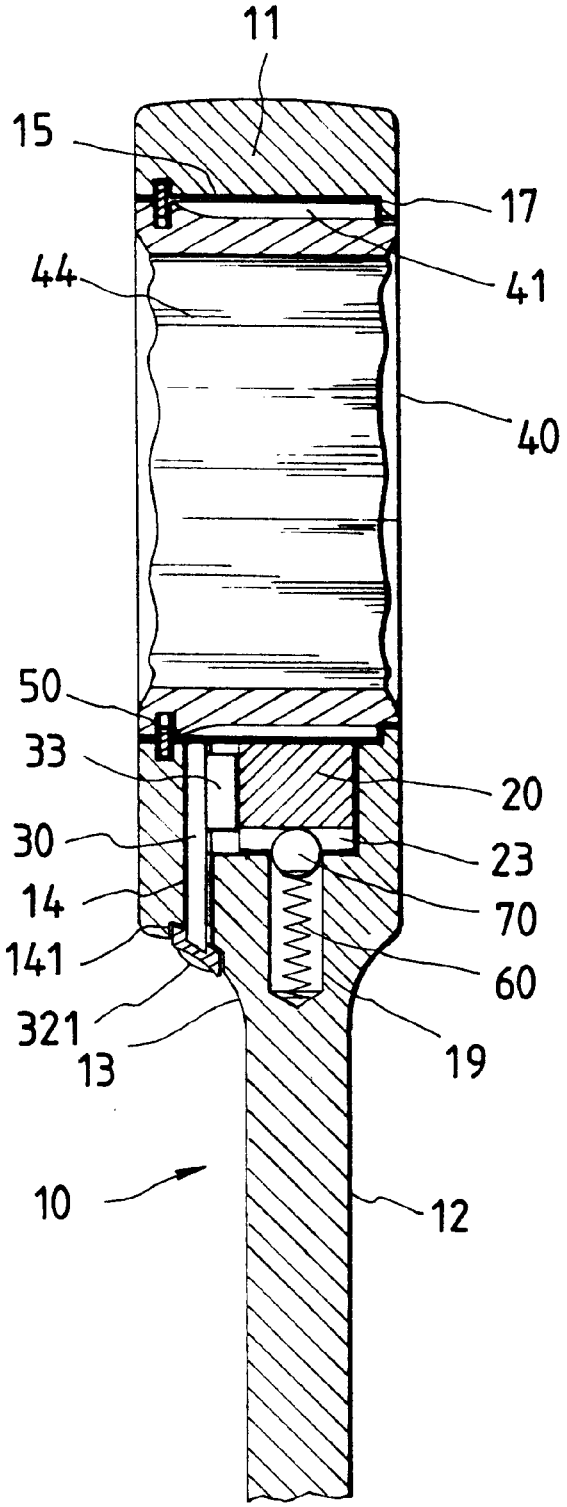
FIG, 8

BOX END WRENCH

FIELD OF THE INVENTION

The present invention relates to box end wrenches and more particularly to an improved box end wrench which is ease of use and sightly.

BACKGROUND OF THE INVENTION

A conventional box end wrench is shown in FIG. 1 comprising a notched member 2, a follower 3, a steel ball 4, a spring 5, a head 1 having a plurality of slots for receiving above components, a snap plate 6 disposed on the top slot of head, and a trigger member 7 on the underside secured to follower 3. In operation, user may clockwise or counterclockwise rotate trigger member 7 to cause notched member 2 to align with an object to be held through follower 3. But this is unsatisfactory for the purpose for which the invention is concerned for the following reasons: First, trigger member 7 is subject to damage during operation because it is projected from the bottom of head 1 of wrench. Further, the projected trigger member 7 is unsightly, thus adversely affecting the competitiveness of such wrenches on the market.

Thus, it is desirable to provide an improved box end wrench in order to overcome the above drawbacks of prior art.

SUMMARY OF THE INVENTION

It is an object of the present invention to provide a box end wrench which is ease of use and sightly. The box end wrench comprises a body including a head, a handle, a slope coupled between the head and the handle, a central opening in the head, a lengthwise channel in the head in communication with the slope, an upper circular groove in the opening, a lower circular shoulder in the opening, a recess between the opening and the channel and in communication therewith, and a lengthwise receptacle under the channel in communication with the recess; an elastic member received in the receptacle; a steel ball on the front end of the elastic member; a follower means received in the recess and including a convex rear surface, a plurality of projections on the front surface, two spaced projections wherein one of the projections is in contact with the steel ball, and a recessed portion on the top coupled between the rear and the front surfaces thereof; a trigger member in the channel and including a concave front edge, a rear manipulation member projected from the channel, and a riser on the underside matingly disposed on recessed portion; a clip ring; and a hollow cylindrical notched member including a plurality of longitudinal projections on the outer surface matingly engaged with the projections of the follower means, a circular groove on the top edge of the projections of the notched member with the clip ring received between the circular groove of the notched member and the circular groove of the body for rotatably securing the notched member in the opening, a circular shoulder on the bottom edge of the projections the notched member urged against the circular shoulder of the body, and a plurality of longitudinal protuberances on the inner surface; wherein the manipulation member is clockwise or counterclockwise rotatable in a distance defined by the width of the channel for moving the steel ball from one slot to the other slot, thereby adjusting the position of the notched member for aligning with an object to be held.

In one aspect of the present invention, the box end wrench further comprising a step member on the mouth of the channel and wherein the manipulation member is formed as a button.

The above and other objects, features and advantages of the present invention will become apparent from the following detailed description taken with the accompanying drawings.

BRIEF DESCRIPTION OF THE DRAWINGS

FIG. 2 is an exploded view schematically showing a first preferred embodiment of box end wrench according to the invention;

FIG. 3 is a perspective view of the FIG. 2 wrench;

FIG. 4 is a top plan view in part section of the FIG. 3 wrench where steel ball is engaged with one slot in a storage position;

FIG. 5 is a sectional view of the FIG. 3 wrench;

FIG. 6 is a view similar to FIG. 4 where steel ball is engaged with another slot in a use position;

FIG. 8 is a sectional view of the FIG. 7 wrench.

DETAILED DESCRIPTION OF THE PREFERRED EMBODIMENTS

Figure 1:
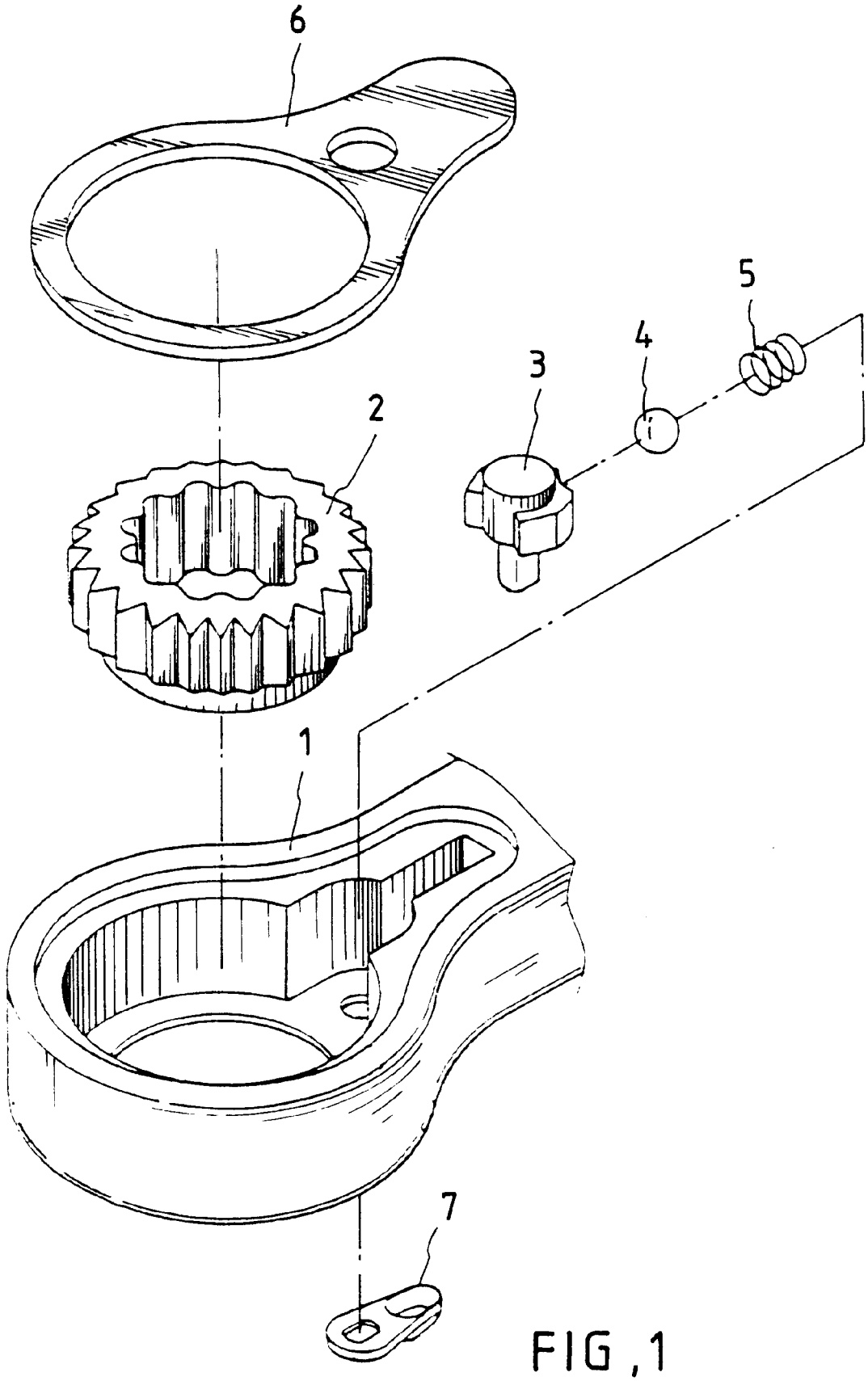
FIG. 1 is an exploded view of a conventional box end wrench.

Referring to FIGS. 2 to 6, there is shown a first embodiment of box end wrench constructed in accordance with the invention comprising a body 10 including a head 11, a handle 12, a slope 13 coupled between head 11 and handle 12, a central opening 15 in the head 11, a lengthwise channel 14 in the head 11 in communication with the slope 13, a circular groove 16 in the upper part of the opening 15, a circular shoulder 17 in the lower part of the opening 15, a recess 18 between the opening 15 and the channel 14 and in communication therewith, and a lengthwise receptacle 19 under channel 14 in communication with recess 18; a coil spring 60 received in receptacle 19; a steel ball 70 on the front end of spring 60; a follower 20 completely received in recess 18 and including a convex rear surface 21, a plurality of projections 22 on the front surface, a longitudinal ridge 25 on the rear surface 21, two projections 23 spaced apart by the ridge 25 in which one of them is in contact with the steel ball 70, and a recessed portion 24 on the top coupled between the rear and the front surfaces thereof; a thin trigger member 30 in the channel 14 and including a concave front edge 31, a rear finger tab 32 projected from the channel 14, and a riser 33 on the underside matingly disposed on recessed portion 24; a clip ring 50; and a hollow cylindrical notched member 40 including a plurality of longitudinal projections 41 on the outer surface matingly engaged with projections 22 of follower 20, a circular groove 42 on the top edge of projections 41 with the clip ring 50 received between the circular groove 42 of notched member 40 and circular groove 16 of body 10 for rotatably securing notched member 40 in opening 15, a circular shoulder 43 on the bottom edge of projections 41 urged against circular shoulder 17 of body 10, and a plurality of longitudinal protuberances 44 on the inner surface.

Referring to FIGS. 4 and 6 specifically, the operation of the box end wrench of the invention will now be described. As shown in FIG. 4, steel ball 70 is urged against one slot 23 by the energized spring 60 in a storage position. In use, user may clockwise (as viewed in FIG. 6) rotate finger tab 32 a distance defined by the width of channel 14 in order to align notched member 40 with an object to be held. Hence, steel ball 70 is retracted into the receptacle 19 due to the compression of spring 60, thus enabling to move from one slot 23 to the other slot 23 by crossing the ridge 25. At the same time, the engaged portion of projections 41 of notched member 40 and projections 22 of follower 20 moves from one side of follower 20 to the other side and secured therein. Accordingly, a rotational force exerted on handle 12 may cause the notched member 40 to rotate the held object through the activation of trigger member 30 and the engaged follower 20. Likewise, a counterclockwise rotation of finger tab 32 an also be performed for rotating the held object counterclockwise. In view of above, the operation of the box end wrench is easy and the appearance thereof is also sightly.

Figure 7:
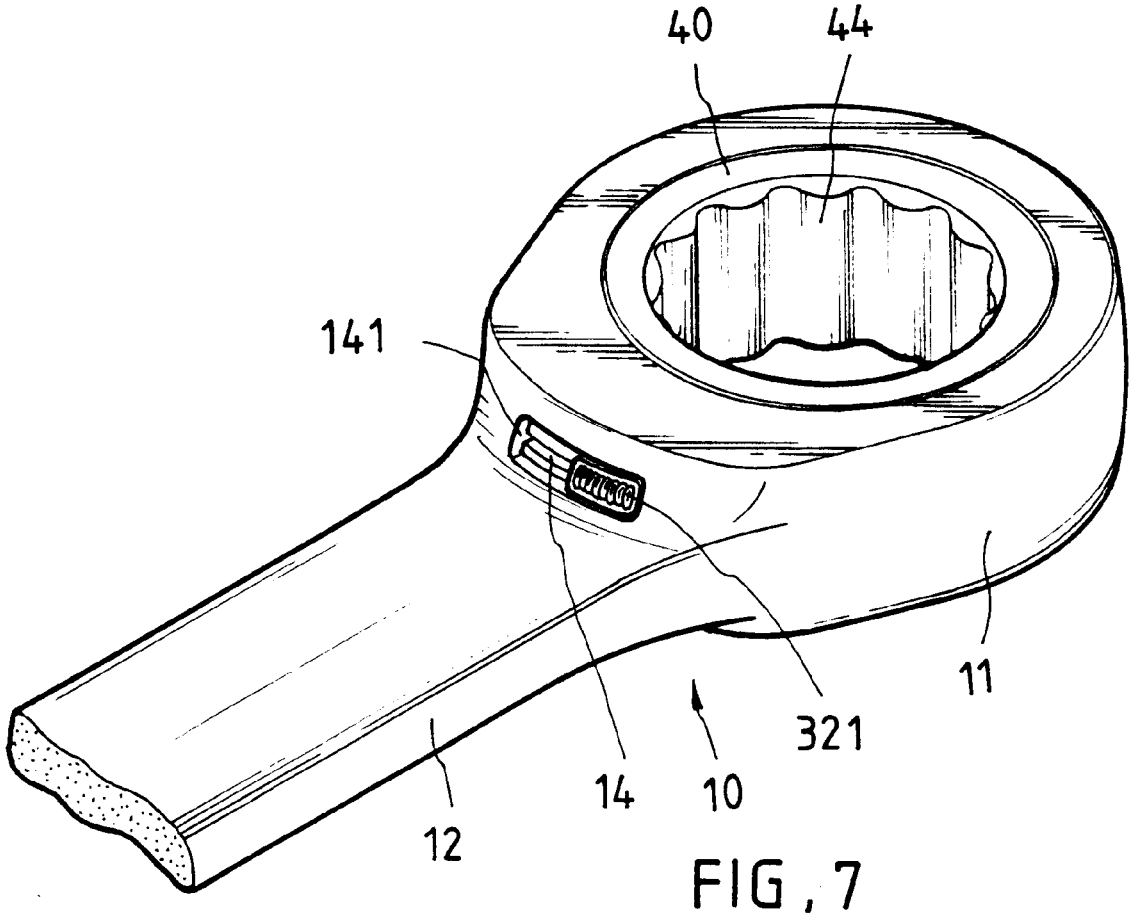
FIG. 7 is a perspective view of a second preferred embodiment of box end wrench according to the invention.

Referring to FIGS. 7 and 8, there is shown a second embodiment of box end wrench constructed in accordance with the invention. The differences between first and second embodiments are that in the second embodiment a step member 141 is formed on the mouth of channel 14 and a slightly projected button 321 is formed on the rear of trigger member 30 in replacement of finger tab 32. This design results in a substantially smooth surface around the mouth of channel 14. Hence, it is more sightly.

While the invention has been described by means of specific embodiments, numerous modifications and variations could be made thereto by those skilled in the art without departing from the scope and spirit of the invention set forth in the claims.

What is claimed is:

1. A box end wrench comprising:

a body including a head, a handle connected to said head, a central opening in said head, a lengthwise channel in said head in communication with said slope, an upper circular groove in said opening, a lower circular shoulder in said opening, a recess extending between said opening and said channel, and a lengthwise receptacle under said channel in communication with said recess;

an elastic member received in said receptacle;

a steel ball on said front end of said elastic member a follower means received in said recess and including a convex rear surface, a plurality of projections on said front surface, a longitudinal ridge on said rear surface, two shoulders spaced apart by said ridge wherein one of said shoulders is in contact with said steel ball, and a recessed portion on said top coupled between said rear and said front surfaces thereof;

a trigger member in said channel and including a concave front edge, a rear manipulation member projected from said channel and a riser on said underside disposed on said recessed portion;

a clip ring; and a hollow cylindrical notched member including a plurality of longitudinal projections on said outer surface that engage said projections of said follower means, a circular groove on said top edge of said projections of said notched member with said clip ring received between said circular groove of said notched member and said circular groove of said body for rotatably securing said notched member in said opening, a circular shoulder on said bottom edge of said projections, said notched member being urged against said circular shoulder of said body, and a plurality of longitudinal protuberances on said inner surface;

wherein said manipulation member is movable within said channel, movement of said manipulation member moving said follower means and thereby moving said steel ball from a first one of said shoulders to a second one of said shoulders, said projections of said follower means meshing with said longitudinal projections of said notched member, so that a position of said notched member is adjusted.

2. The box end wrench of claim 1 further comprising a step member on said mouth of said channel.

3. The box end wrench of claim 1 wherein said manipulation member is a button.

* * * * *